US005099578A

United States Patent [19]

Jan

[11] Patent Number: 5,099,578

[45] Date of Patent: Mar. 31, 1992

[54] RETRACTABLE KNIFE

[76] Inventor: Rong S. Jan, No. 672-11, Pei-Ser-Wei, Pei-Hu-Li, ChiaYi City, Taiwan

[21] Appl. No.: 696,785

[22] Filed: May 7, 1991

[51] Int. Cl.[5] ..... B26B 3/00

[52] U.S. Cl. ..... 30/162; 30/335

[58] Field of Search ..... 30/162, 163, 151, 335, 30/336

[56] References Cited

U.S. PATENT DOCUMENTS 4,242,795 1/1981 Rollband et al. ..... 30/162

4,586,256 5/1986 Weimann ..... 30/162

4,761,882 8/1988 Silverstein ..... 30/162

4,939,839 7/1990 Gorst ..... 30/162 X 4,974,320 12/1990 Pelletier ..... 30/162 X

*Primary Examiner*—Douglas D. Watts

*Attorney, Agent, or Firm*—Fleit, Jacobson, Cohn, Price, Holman & Stern

[57] ABSTRACT

An improved retractable knife comprises two coalescent casings which has a sliding seat and a driving button inside. Two casings are combined firmly so that the sliding seat can move inside the casings firmly.

5 Claims, 2 Drawing Sheets

RETRACTABLE KNIFE

BACKGROUND OF THE INVENTION

This invention relates to the structure of an improved retractable knife. In the conventional retractable knife, the blade is mounted on the sliding seat which uses the side teeth to contact with the slot of casing so that the side teeth and the slot will be deflective and loose when the retractable knife is pressed for using. Moreover, the casings of retractable knife will burst apart so that the blade may fly out to hurt people.

SUMMARY OF THE INVENTION

The purpose of this invention is to provide an improved retractable knife whose two coalescent casings will not burst apart. Also the sliding seat moves firmly inside the casings and will not deflect and loosen.

This invention relates to combine two casings to form a knife tool which has symmetric notches and slot tracks to provide a driving button protruding out. A sliding seat inserts between two casings. The one side of sliding seat has a lug to engage with the blade which adheres to the track of one casing. The other side of sliding seat adheres to the inner wall of the other casing. By pressing the driving button, the teeth of driving button and the rack of casing will be separated so that the driving button drives the sliding seat for the blade stretching or retracting inside the casings.

BRIEF DESCRIPTION OF THE DRAWINGS

This invention will now be described in detail with reference to the accompanying drawings wherein.

DETAILED DESCRIPTION OF THE INVENTION

Figure 1:
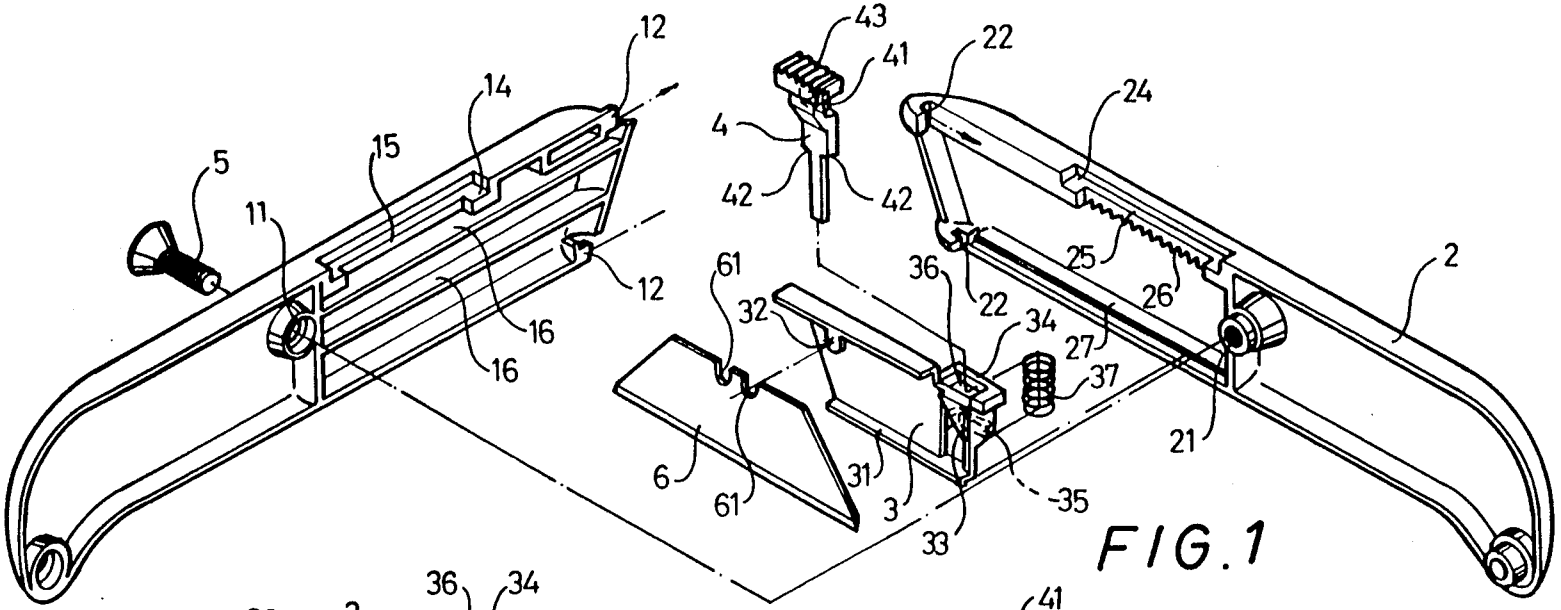
FIG. 1 is a solid exploded perspective view of this invention.
Figure 5:
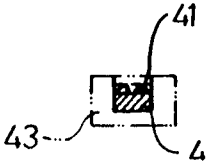
FIG. 5 is a cross-sectional view taken along line 5—5 of FIG. 6.
Figures 6, 7:
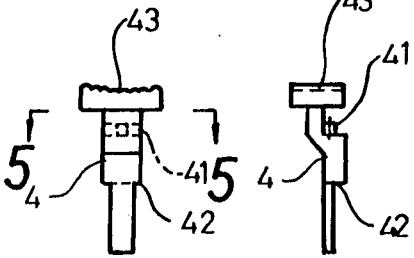
FIG. 6 is a front view of driving button in accordance with this invention.
FIG. 7 is a side view of driving button in accordance with this invention.
Figure 4:
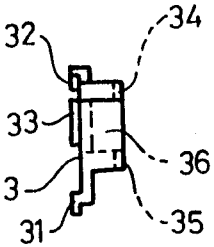
FIG. 4 is a side view of sliding seat in accordance with this invention.
Figure 2:
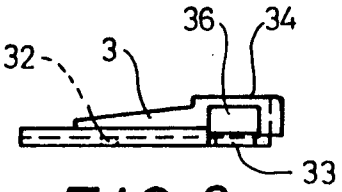
FIG. 2 is a top view of sliding seat in accordance with this invention.
Figure 3:
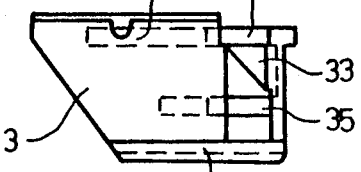
FIG. 3 is a front view of sliding seat in accordance with this invention.

First, referring to FIG. 1, two casings (or casing parts) 1,2 combine to form a hollow knife handle. The casing 1 has a hole 11 to provide passing through a bolt 5 which also screws the screw hole 21 of casing 2 to combine with casings 1,2 so that the casings 1,2 will not burst apart. The casing 1 has a hook 12 (or projection) 12 and the casing 2 has a dent (or recess) 22 so that the hook 12 will block the dent 22. The casing 1 has a shaft hole 13 to insert the shaft tube 23 of casing 2 so that the casings 1,2 will combine firmly. The casing 1 has a notch 14 which has a slot track 15 so that the driving button (or member) 14 can move along the slot track 15. Also the casing 2 has a notch 24 to engage with the casing 1. The notch 24 also has a slot track 25. A rack 26 is at the bottom of notch 24 near the slot track 25 to engage with the teeth 41 of driving button 4. The casing 2 has a track 27 whose height is shorter than the thickness of the casing 2 with a gap between the track 27 and the bottom of casing 2 so that the track 27 can guide the sliding seat 3 moving straightly.

Referring to FIG. 1 to FIG. 4, the sliding seat 3 moves between two casings 1,2. The sliding seat 3 has a track 31 protruding downward. The track 31 adheres to the track 27 of casing 2 so that the sliding seat 3 moves firmly inside the casings 1,2. The one side of sliding seat 3 has a plane to install the blade 6 and has a bulge 32 to block the dent 61 of the blade 6. The sliding seat 3 has a block 33 to limit the blade 6. After the blade 6 mounting on the sliding seat 3, the blade 6 adheres to the track 16 of casing 1. The other side of sliding seat 3 adheres to the inner wall of casing 2 so that the sliding seat 3 moves firmly inside the casings 1,2. The sliding seat 3 has two symmetric limiting frames 34,35 (defining a receiver) which have a pair of engaging holes 36 for passing through the stud (or stem) of driving button 4. The limiting frames 34,35 are to limit both ends of a coil spring 37 which is to provide the driving button 4 passing through.

Referring to FIGS. 1,5,6,7, the driving button 4 comprises a long stud to pass through the holes 36 of sliding seat 3 and the coil spring 37. The driving button 4 has two protruded shoulders 42 to press the upper end of spring 37 so that the driving button 4 has a rising force for the teeth 41 blocking at the rack 26 of casing 2. The top of driving button 4 has a pressing block 43 which protrudes out at the notches 14,24 of casings 1,2. By pressing the pressing block 43 to lower the driving button 4, the teeth (or protrusions) 41 of driving button 4 descend to detach from the rack 26 of casing 2 so that the driving button 4 can move along the slot tracks 15,25 of casings 1,2.

Figure 8:
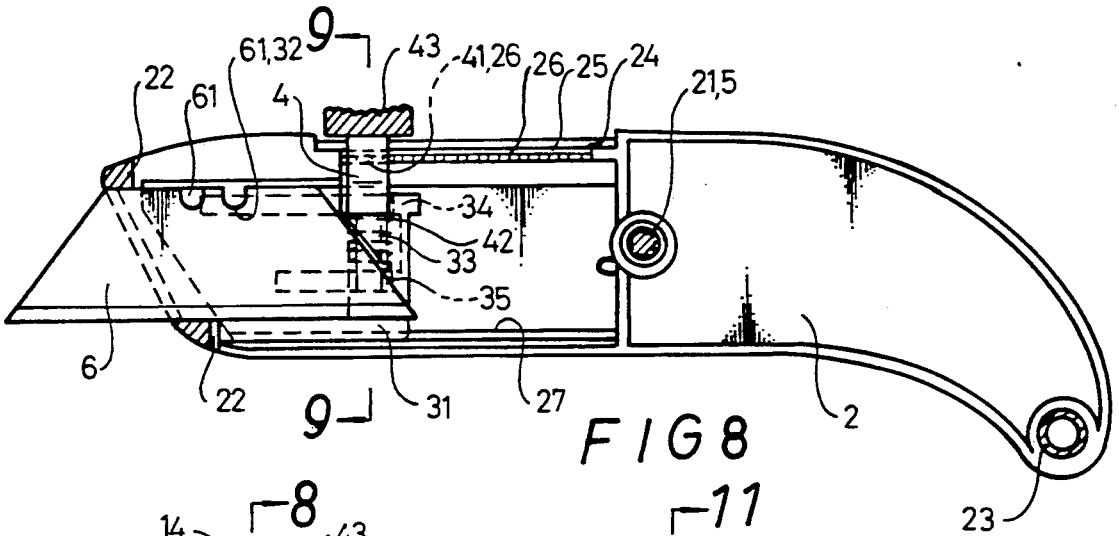
FIG. 8 is a cross-sectional view taken along line 8—8 of FIG. 9.

Referring to FIG. 8, the driving button 4 and the sliding seat 3 in accordance with this invention combine together inside the casing 2. After the driving button 4 combining with the hole 36 of sliding seat 3, the driving button 4 is pushed by the coil spring 37 so that the teeth 41 of driving button 4 block the rack 26 of casing 2 a shown in FIG. 9. The teeth 41 stay at the ultra-left end of rack 26 so that the blade 6 can extend out the casing 2 at the longest length. Moreover, the teeth 41 can stay at any position of the rack 26 so that the blade 6 can retract into the casing 2 or extend out at a shorter length.

Figure 9:
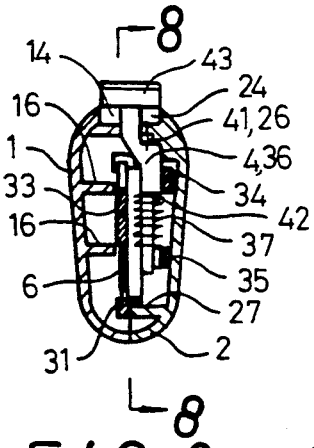
FIG. 9 is a cross-sectional view taken along line 9—9 of FIG. 8.
Figure 10:
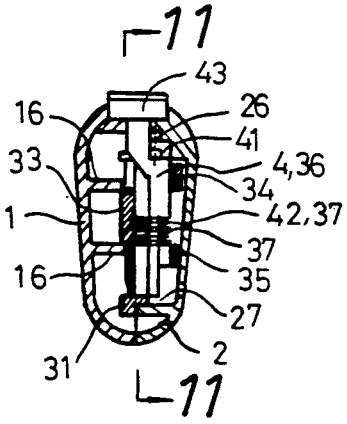
FIG. 10 is a cross-sectional view taken along line 10—10 of FIG. 11.
Figure 11:
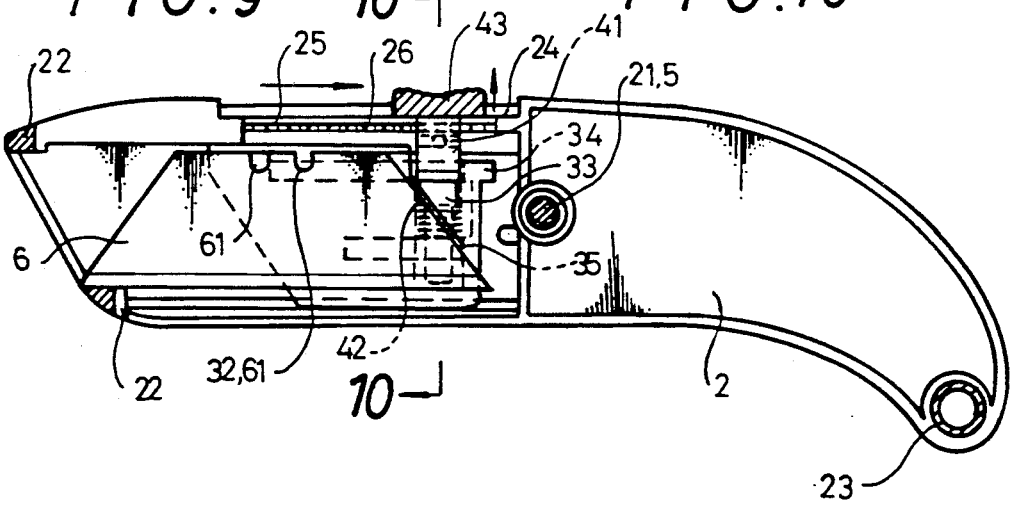
FIG. 11 is an actional view of blade retracting inward of FIG. 8.

When the blade have to change its length as shown in FIG. 9, the teeth 41 and the rack 26 will be detached by pressing the pressing block 43 of driving button 4 down, as shown in FIG. 10, so that the driving button 4 can move along the slot tracks 15,25. When the driving button 4 is released, the driving button 4 will be retracted by the coil spring 37 so that the teeth 41 will stay at any position of the rack 26.

The features of this invention include not only the bolt 5 screwing two casings 1,2 tightly, but also the hook 12 blocking the dent 22 and the shaft tube 23 inserting into the shaft hole 13 so that two casings will combine firmly without break. Instantaneously, the sliding seat 3 adheres tightly inside two casings 1.2 without any deflection and swerve.

What is claimed is:

1. A retractable knife comprising first and second complimentary elongated casing parts, attachment means fastening the casing parts together to define a hollow knife handle having a knife blade opening at a forward end thereof and an elongated slot along an upper surface thereof with a toothed rack along one longitudinal wall of the slot, a sliding knife blade set contained within said handle for lengthwise sliding in the handle to extend and retract a knife blade carried by the seat through said opening, an upwardly open receiver formed on said seat, a driving member having an upper push button section extending out of the handle through said slot, an intermediate section, and a lower stem section, the stem section being contained in said receiver, the intermediate section having a side surface formed with a protrusion complimentary to teeth of said rack, a shoulder below said protrusion, and a spring in said receiver urging the driving member upwardly to engage the shoulder against said wall of the handle with said protrusion engaging said teeth and preventing lengthwise movement of the sliding seat within the handle, the driving member being depressible by said push button section against the action of the spring to disengage the protrusion from said teeth and allow for lengthwise movement of the seat and driving member along the handle to extend and retract the blade through said opening.

2. The knife as claimed in claim 1 wherein the spring comprises a coil spring surrounding the stem section of the driving member.

3. The knife as claimed in claim 1 wherein the sliding seat includes a track portion slidable on a corresponding elongated track element formed in one of said casing parts.

4. The knife as claimed in claim 3 wherein the other of said casing parts has an elongated guide for engaging a side surface of the knife blade.

5. The knife as claimed in claim 1 wherein one of said casing parts has a projection adjacent said opening fitting in a corresponding recess in the other of said casing parts.

* * * * *